US007533632B2

(12) United States Patent
Stone et al.

(10) Patent No.: US 7,533,632 B2
(45) Date of Patent: May 19, 2009

(54) NATURAL CIRCULATION INDUSTRIAL BOILER FOR STEAM ASSISTED GRAVITY DRAINAGE (SAGD) PROCESS

(75) Inventors: Bryan B. Stone, Cambridge (CA); Jonathan D. Fleming, Kitchener (CA)

(73) Assignee: Babcock & Wilcox Canada, Ltd., Cambridge Ontario (CA)

( * ) Notice: Subject to any disclaimer, the term of this patent is extended or adjusted under 35 U.S.C. 154(b) by 0 days.

(21) Appl. No.: 11/742,870

(22) Filed: May 1, 2007

(65) Prior Publication Data

US 2007/0266962 A1 Nov. 22, 2007

(51) Int. Cl.
*F22G 7/14* (2006.01)
*F22B 25/00* (2006.01)

(52) U.S. Cl. ..... 122/235.12; 122/409; 122/235.23; 122/235.31; 122/463

(58) Field of Classification Search ..... 122/409, 122/461, 8, 9, 235.12, 235.14, 235.19, 235.21, 122/235.22, 235.23, 235.24, 235.31, 235.32, 122/1 B, 406.4, 469, 463, 282, 235.29, 235.15, 122/235.35
See application file for complete search history.

(56) References Cited

U.S. PATENT DOCUMENTS

| | | | | | |
|---|---|---|---|---|---|
| 140,908 | A * | 7/1873 | Lowenstein | 422/270 |
| 1,809,097 | A * | 6/1931 | Wood | 122/235.31 |
| 1,932,918 | A * | 10/1933 | Abendroth | 122/235.24 |
| 2,244,451 | A * | 6/1941 | Falla | 122/235.19 |
| 3,046,955 | A * | 7/1962 | Rossi | 122/406.1 |
| 4,196,700 | A * | 4/1980 | Keseru et al. | 122/406.1 |
| 4,294,199 | A * | 10/1981 | Darling et al. | 122/276 |
| 4,665,894 | A * | 5/1987 | Juhasz | 122/18.4 |
| 5,353,749 | A * | 10/1994 | Seibel et al. | 122/240.1 |
| 6,019,040 | A * | 2/2000 | Mollers | 101/366 |
| 6,446,584 | B1 * | 9/2002 | Franke et al. | 122/460 |
| 6,536,380 | B1 * | 3/2003 | Kral et al. | 122/406.4 |
| 7,243,618 | B2 * | 7/2007 | Gurevich | 122/7 R |
| 7,334,542 | B2 * | 2/2008 | Zorzit et al. | 122/235.19 |
| 2006/0175040 | A1 * | 8/2006 | Waseda et al. | 122/510 |

* cited by examiner

*Primary Examiner*—Gregory A Wilson
(74) *Attorney, Agent, or Firm*—Michael J. Seymour; Eric Marich

(57) ABSTRACT

A gravity feed, natural circulation boiler for an SAGD process using low quality feedwater for carbonatious material recovery, has a large diameter steam drum with downcomers. A furnace of the boiler has individually replaceable membrane wall modules, each with upper and lower headers and membrane roof, wall and floor parts connected to the drum and defining a fire box having an inlet end and an outlet end. The furnace includes a membrane front wall connected to the drum with a windbox upstream of the front wall. Burners at the inlet end of the firebox heat the firebox and riser pipes are connected between the steam drum and the upper header for supplying steam to the steam drum when the firebox in heated, the downcomer pipes being connected to the lower header for supplying water from the stream drum under gravity feed so that each module defines a single circuit. Furnace outlet screen bank and subsequent generating banks each with upper and lower headers and associated feeder and riser tubes complete the boiler.

26 Claims, 4 Drawing Sheets

NATURAL CIRCULATION INDUSTRIAL BOILER FOR STEAM ASSISTED GRAVITY DRAINAGE (SAGD) PROCESS

FIELD AND BACKGROUND OF THE INVENTION

The present invention relates generally to boiler design, and in particular, to a new and useful Steam Assisted Gravity Drainage ("SAGD") process boiler with natural circulation for operating with sub-ASME feedwater quality for oil sands, heavy oil and bitumen recovery.

The SAGD boiler design of the present invention has a basis in B&W drum boiler design, knowledge and standards. General boiler design standards are used and then expanded on where required to address specific design issues unique to SAGD.

Improvements have been made to enhance recovery of heavy oils and bitumens beyond conventional thermal techniques. One such technique, for example, is Steam Assisted Gravity Drainage or SAGD, taught by U.S. Pat. No. 4,344,485 issued Aug. 17, 1982 to Butler. This method uses pairs of horizontal wells, one vertically above the other, that are connected by a vertical fracture. A steam chamber rises above the upper well and oil warmed by conduction drains along the outside wall of the chamber to the lower production well.

The recovery of bitumen and subsequent processing into synthetic crude from the oil sands in northern Alberta, Canada continues to expand. Approximately 80% of known reserves are buried too deep to use conventional surface mining techniques. These deeper reserves are recovered using in-situ techniques such as Steam Assisted Gravity Drainage in which steam is injected via the horizontal wells into the oil sands deposit (injection well). This heats the bitumen, which flows by gravity to the other horizontal well lower in the deposit (production well) where the mixture of bitumen and water is taken to the surface. After the water is separated from the bitumen, it is returned to the process where, after treatment, it is returned to the boiler for re-injection into the well.

Re-use of the water resource is a key factor for both conservation and environmental regulations.

Even after treatment, however, the boiler feedwater can still contain volatile and non-volatile organic components as well as high levels of silica. Once Through Steam Generator (OTSG) boiler technology currently being used have experienced tube failures due to poor boiler feedwater quality. Further, the OTSG technology has exhibited limitations in steam quality produced and cost of operation such as high pumping power and cost of condensate handling to satisfy zero-liquid discharge requirements from SAGD plants.

SUMMARY OF THE INVENTION

To address these issues, Suncor (Suncor Energy Inc. of Alberta, Canada) initiated a review of alternate boiler technologies to produce 100% quality saturated steam, and it is an object of the present invention to provide a boiler for use in a SAGD process, the boiler having natural circulation and being designed to operate with sub-ASME feedwater quality for oil sands, heavy oil, bitumen, or other carbonatious material recovery.

Accordingly, an object of the present invention is to provide a gravity feed, natural circulation boiler for a SAGD process using low quality feedwater for carbonatious material recovery, and comprising a steam drum having an inside diameter of about 3 to about 9 feet, a plurality of downcomer pipes connected to the steam drum for discharging water from the stream drum, a furnace having a plurality of individually replaceable membrane wall modules, each module comprising an upper header, a membrane roof connected to and sloping downwardly away from the upper header, a membrane wall connected to and descending from the membrane roof, a membrane floor connected to and sloping downwardly from the membrane wall, and a lower header connected to the membrane floor, the roof, the wall and the floor together defining a firebox having an inlet end and an outlet end, and the furnace including a membrane front wall connected to the upper and lower header and being at the inlet end of the fire box, means defining a windbox upstream of the front wall, at least one burner at the inlet end of the firebox for heating the firebox, a plurality of riser pipes connected between the steam drum and the upper header for supplying steam to the steam drum when the firebox in heated, the downcomer pipes being connected to the lower header for supplying water from the stream drum under gravity feed so that each module defines a single circuit, a rear wall screen at the outlet of the firebox, connected between the downcomer pipes and the riser pipes, at least one stream generator bank downstream of the screen and also connected between the downcomer pipes and the riser pipes, a stack connected to the firebox outlet downstream of the bank, and a economizer located prior to or in the stack.

Another object of the invention is to provide such a boiler with a selective catalytic reduction or SCR module between the firebox outlet and the stack and/or to include a transition flue of reducing cross-sectional area between the firebox outlet and the stack.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
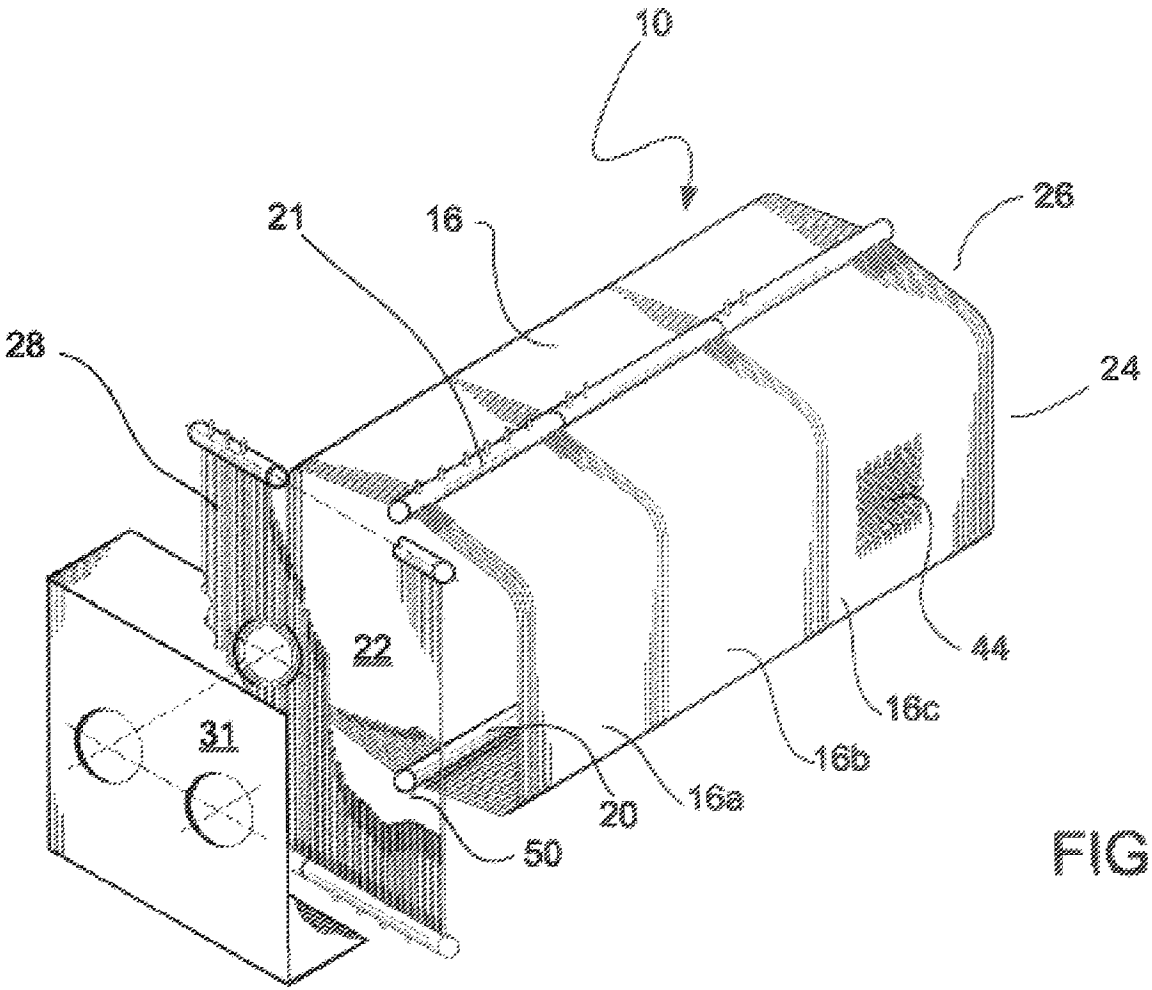
FIG. 1 is a perspective view of a boiler for use in an SAGD process according to the present invention.

Referring now to the drawings, in which like reference numerals are used to refer to the same or similar elements, the drawings show a gravity feed, natural circulation boiler 10 for an SAGD process using low quality feedwater for carbonatious material recovery, and comprising a steam drum 14 having an inside diameter of about 3 to about 9 feet, a plurality of downcomer pipes 12 connected to the steam drum for discharging water from the stream drum, a furnace 16 having a plurality of individually replaceable membrane wall modules, each module comprising an upper header 21, a membrane roof 26 connected to and sloping downwardly away from the upper header, a membrane wall 24 connected to and descending from the membrane roof by gently curved tubes (e.g. having a radius of curvature of less than about 3 feet), a membrane floor 22 connected to and sloping downwardly from the membrane wall (also by gently curved tubes having a radius of curvature of less than about 3 feet for example), and a lower header 20 connected to the membrane floor, the roof, the wall and the floor together defining a fire box having an inlet end and an outlet end. The preferred sloping of the roof and floor with respect to its respective header is about 2 to 30 degrees to the horizontal, or more preferably about 5 to 15 degrees or about 10 degrees in the illustrated embodiments.

The furnace 16 includes a membrane front wall 28 connected to the upper and lower header and being at the inlet end of the fire box. Means such as metal walled define a windbox 31 upstream of the front wall. One or more burners 30 at the inlet end of the firebox for heating the firebox. A plurality of riser pipes 36 are connected between the steam drum and the upper header for supplying steam to the steam drum when the firebox in heated, the downcomer pipes being connected to the lower header for supplying water from the stream drum under gravity feed so that each module defines a single circuit.

A rear wall screen 32 at the outlet of the firebox is connected between the downcomer pipes 18 and the riser pipes 36 and at least one steam generator bank 33 is downstream of the screen 32 and is also connected between the downcomer pipes and the riser pipes. A stack 42 is connected to the firebox outlet downstream of the bank and an economizer 40 is in the stack. In an alternative embodiment (not shown) the economizer is positioned prior to the stack.

The boiler may include an SCR or selective catalytic reduction module 46 between the firebox outlet and the stack and a transition flue 38 of reducing cross-sectional area is between the firebox outlet and the stack.

To address the issues of appropriate boiler design for an SAGD process, Suncor's review of the alternate boiler technologies resulted in Suncor's issuance of specification SP100-A-100-1 dated 17 Feb. 2004. This specification included a water analysis that has constituent concentrations that exceed ASME guidelines for boiler feedwater. With current drum boiler accepted standards in mind, a risk analysis to indicate the relative risk factors for each constituent at 1000 psig boiler design pressure was performed at B&W Barberton. Following is a summary of this analysis, along with comments.

TABLE 1

BOILER FEEDWATER CONCENTRATIONS

| | Indicated distillate con-centration | Low risk ASME con-centration | Medium risk** con-centration | High risk** con-centration |
|---|---|---|---|---|
| Oil &other nonvolatile organic, ppm TOC | up to 10 | <0.2 | <0.5-1 | 2-4 |
| Volatile organic, ppm TOC | up to 90 | Eliminated by deaerator? | Eliminated by deaerator? | Eliminated by deaerator? |
| Silica, ppm | <1 | <0.4 | 0.5-1 | 1-2.5 |
| Calcium + magnesium, ppm | 0.015 | <0.02 | <0.05 | *** |
| Sodium + potassium, ppm | 3.8 | <15* | <20* | *** |
| Iron, ppm | <0.02 | <0.02 | <0.05 | *** |
| Carbonate, ppm TIL | <2 | <1* | <2* | *** |
| Chloride, ppm | 4.9 | <7 | 7-20 | *** |
| Sulfate, ppm | <2 | <30* | <40* | *** |
| TDS, ppm | <10 | <40* | <60* | *** |
| pH | 8-10 | 8.8-9.6 | 8-10 | *** |

TABLE 1-continued

BOILER FEEDWATER CONCENTRATIONS

| | Indicated distillate con-centration | Low risk ASME con-centration | Medium risk** con-centration | High risk** con-centration |
|---|---|---|---|---|

*Assuming blowdown rate is 5% of steam generation rate.
**Requires conservative boiler design.
***Values not established.

According to the present invention, feedwater deaeration is expected to purge the volatile fraction of organics from the water, so they are not expected to be present in the boiler feedwater. This will leave only the residual (up to 10 ppm) oil, grease and other nonvolatile organics in the feedwater. Testing indicated that the expected (design) oil and grease concentration in source water into the evaporator is about 10 ppm so that 10 ppm is the maximum oil and grease concentration in the distillate. Steam/water separation in the evaporator will result in non-volatile organics concentrations in the distillate being significant but less, and probably much less, than 10 ppm. The chemical nature of these organics determines their behavior in boilers and determine their effect on boiler serviceability.

The revised silica concentration is also high (beyond recommended feedwater silica limits for most boilers) but tractable. Indicated concentrations for other species are within acceptable limits for most 900 psi boilers. However, because the chloride concentration is high relative to that of other species, care should be taken to avoid conditions that are conducive to under-deposit corrosion.

Risk Versus Feedwater Chemistry:

Table 1 above, indicates estimated level of risk associated with different concentrations of common boiler feedwater impurities. Risk levels are defined in terms of the likelihood of problems (1) in boilers with high heat fluxes and high concentration factors and (2) in more conservatively designed boilers with lower heat fluxes and concentration factors. Risk levels are also defined in terms of the level of chemical expertise and technology required to prevent excessive deposition and corrosion.

Definitions:

Low risk limits: Industry wide standard and common operating range for most industrial 900-1000 psi boilers. Acceptable water chemistry can be maintained by industry common practice. Excessive deposition and corrosion generally occur only where there is contamination beyond indicated limits (e.g. caused by condenser leaks, poor startup practice or purifier failures), poor implementation of feedwater and boiler water treatment, or poor boiler operation (e.g. burner misalignment or low drum level);

Medium risk limits: Impunity levels are high but within range of operation for conservatively designed and operated 900-1000 psi boilers at other locations. Assistance of astute and experienced water chemist and state of the art treatment chemicals and practices may be needed to avoid excessive deposition and corrosion. Problems are possible or even probable, but likely to be solvable with appropriate feedwater and boiler water additives and vigilant control.

High risk limits: beyond operating range for most boilers. Probably feasible with conservative boiler design and special water chemistry control measures, but feasibility cannot be assured. Operation in this range requires pushing limits of established water treatment experience and technologies.

Conservative design: Boilers or conservative design with respect to water chemistry have lower maximum local heat fluxes and concentration factors in areas of steam generation. Consequently, maximum deposit formation rates tend to be lower, and thicker deposits can be tolerated with less tendency for under-deposit corrosion and over heat failures.

Conservative design characterisitics include four factors:

(1) moderate maximum local heat flux;

(2) minimized steam/water stratification in horizontal and sloped tubes, accomplished by increased flow to these tubes and/or application of ribbed tubing;

(3) assured flow stability in all circuits over expected range; and (4) provision for easy acid cleaning, including provision for easy filling, draining and venting.

Basic Design Rules:

Limit furnace heat release (< about 120,000 Btu/hr/ft$^2$) based on known boiler practice;

Minimize local heat flux (burner clearances and heat input/burner (< about 165 MBtu/hr));

Reduce FEGT (inlet temperature to Gen. Bank) (about 2400 F);

Maximize circulating velocity and turbulence;

Limit top quality (reduce steam/water stratification);

Short waterwall and Gen. Bank circuits;

Increase tube, header and drum size;

Avoid tight bends;

Ensure flow stability in all circuits over load range;

Provision for easy acid or mechanical cleaning;

Modular construction suitable for truck transport to remote site;

Simple to erect to minimize field labor;

Removable generating bank modules to minimize downtime—simple, easy to repair/replace;

Bottom supported unit; and

Generating capacity 75,000 to 1,000,000 lb/hr of saturated steam at pressures ranging from 600 to 1600 psig operating pressure.

All of these design rules need not be present in all boilers of the present invention since some rules can be optimized to compensate for loosening other rules, however, each boiler of the present invention is enhanced for use as SAGD process boiler with natural circulation designed to operate with sub-ASME feedwater quality for oil sands heavy oil and bitumen recovery or the like, by following as many of the rules as is practical. These design rules cannot be satisfied with existing B&W Industrial boiler technology, specifically PFI or PFT boiler design.

Preferred Embodiments

The boiler of the invention is a new natural circulation boiler type that is capable of operating with sub-ASME feedwater quality available from a bitumen recovery SAGD process in the oil sands of Alberta, for example, and, again for example, a 75,000 to 1,000,000 lb/hr unit. The invention is meant to satisfy the market need for such a boiler.

Figure 2:
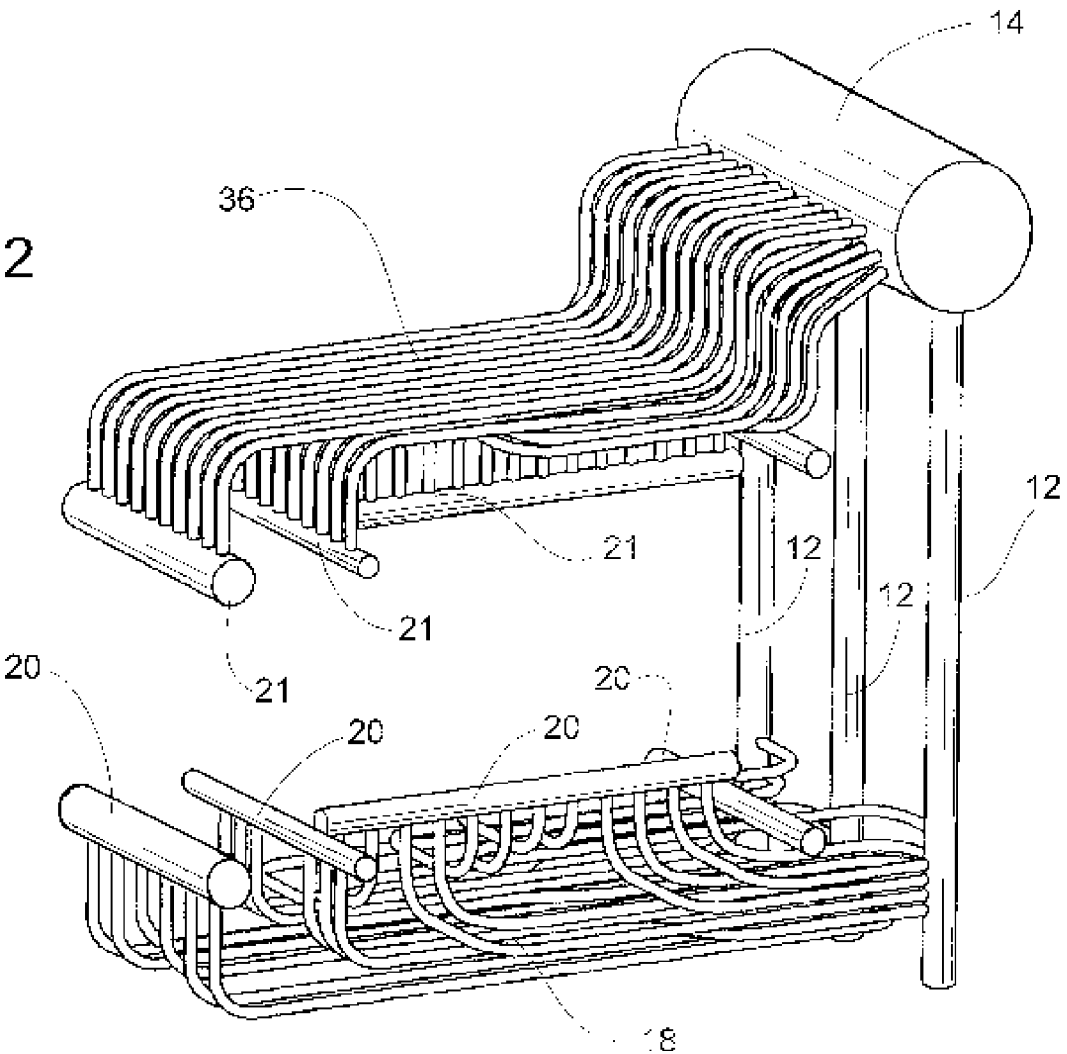
FIG. 2 is a perspective view of an arrangement the feeders and risers for a steam drum of the boiler of the invention.

With reference to FIGS. 1 and 2, the boiler 10 is a natural circulation design utilizing unheated downcomers or downcomer pipes 12 and the single relatively large diameter steam drum 14. The drum includes steam separation internals of known design to provide dry saturated steam to the process. See, for example, the B&W publication, *Steam: its generation and use, Edition* 41, The Babcock & Wilcox Company, a McDermott Company, 2005, pages 5-14 and 5-15.

The drum 14 is larger in diameter than typically provided for industrial boilers to accommodate possible foaming due to organic contaminants in the feedwater, for example a 6 foot inside diameter (ID) drum is used for the invention (or a steam drum in the range of 3 to 9 feet ID, or preferably 4 to 8 feet ID, or more preferably 5-7 feet ID).

From drum 14, downcomer pipes 12 feed water to the furnace 16 via feeder tubes 18 connecting the downcomers 12 and lower headers 20. The furnace 16 is water-cooled membrane panel construction. An integrated configuration is used such that the floor 22, walls 24 and roof 26 of the furnace are a single water circuit. This reduces the circuit length to reduce chances of internal deposits. The furnace 16 is configured to avoid sloped tubes with shallow angles. In addition, sloped tube lengths are kept to a minimum to avoid steam/water segregation inside the tube. The furnace front wall 28 is a vertical panel of membrane construction and houses the burners 30 and windbox 31. The roof 26, the wall 24 and the floor 22, together defining a firebox having an inlet end at the front wall 28, and an outlet end, burners being at the inlet end of the firebox for heating the firebox.

The lower headers 20 are all provided with access to at least one but preferably multiple drains, e.g. at 50, for draining and cleaning of the water circuits.

Figure 3:
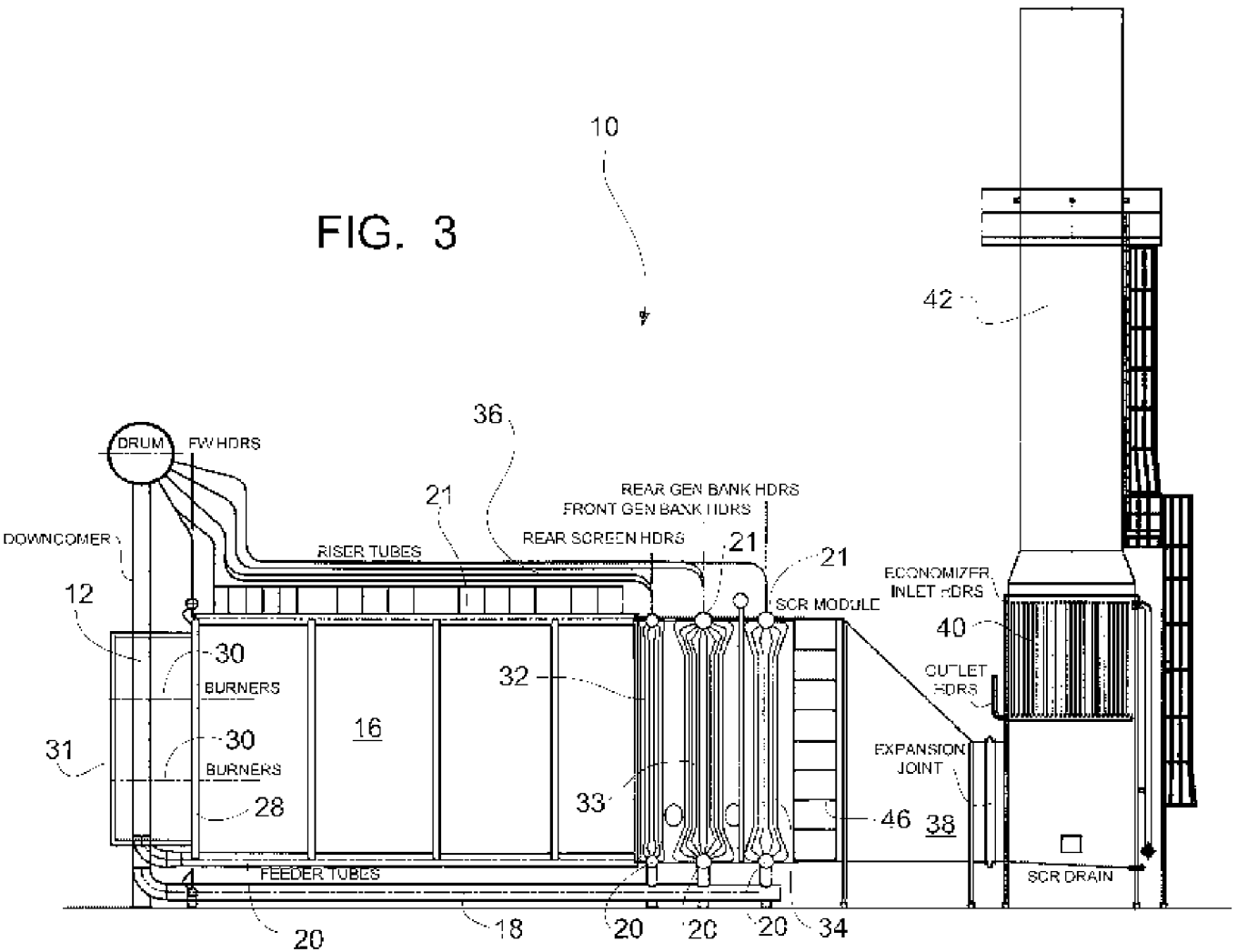
FIG. 3 is a side elevational view of a boiler of the present invention.
Figure 4:
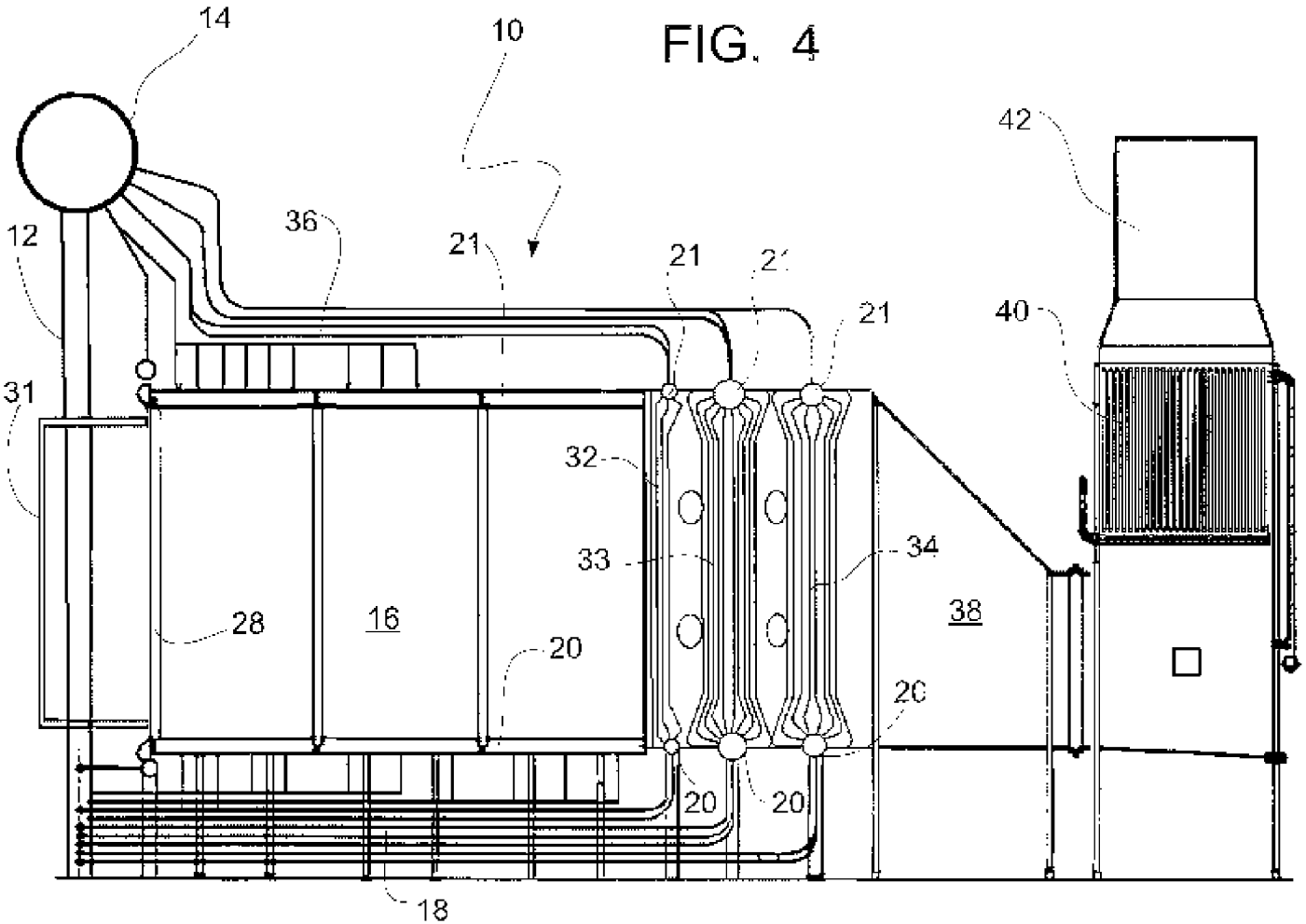
FIG. 4 is a view similar to FIG. 3 of another embodiment of the boiler of the invention.

The balance of the boiler comprises furnace steam generation surface arranged in three (or more) modules 16*a*, 16*b* and 16*c* (FIG. 1). In the direction of flue gas flow which is left to right in FIG. 1, the modules are in sequence; the rear wall screen 32 and generating banks one at 33 and two at 34 in FIGS. 3 and 4. Each bank is modularized for transportation and ease of replacement. The screen bank and the first generating bank include wall and roof tubes that form the gas boundary.

The steam generation components (furnace and convective surface) are interconnected to the steam drum 14 via risers or riser pipes 36 between the upper headers 21 and the steam drum. This completes the circulation loop. The outer membrane walls of furnace 16 are preferably covered with insulation, e.g. about 3" to 6" minimum fiber board, shown at 44 for example.

From the convective surface, the gas travels through a transition flue 38 to an economizer 40 and stack arrangement 42 as in standard industrial boiler. The boiler of FIG. 3 includes a selective catalytic reduction or SCR module 46 between the firebox outlet and the stack 42 and the transition flue 38 is of reducing cross-sectional area between the firebox outlet and the stack.

While specific embodiments of the invention have been shown and described in detail to illustrate the application of the principles of the invention, it will be understood that the invention may be embodied otherwise without departing from such principles.

We claim:

1. A gravity feed, natural circulation boiler for an SAGD process using low quality feedwater for carbonatious material recovery, comprising:

a single steam drum having an inside diameter;

a plurality of downcomer pipes connected to the steam drum for discharging water from the stream drum;

a single furnace having a plurality of individually replaceable membrane wall modules, each module comprising at least one upper header, a membrane roof connected to and first sloping downwardly away from the upper header, a membrane wall connected to and descending from the membrane roof, a membrane floor connected to and sloping downwardly from the membrane wall and subsequently connected into a lower header without any subsequent bends; the roof, the wall and the floor together defining a fire box having an inlet end and an outlet end, and the furnace including a membrane front wall connected to the upper and lower headers and being at the inlet end of the fire box;

means defining a windbox upstream of the front wall;

at least one burner at the inlet end of the firebox for heating the firebox;

a plurality of riser pipes connected between the steam drum and the upper header for supplying steam to the steam drum when the firebox in heated, the downcomer pipes being connected to the lower header for supplying water from the stream drum under gravity feed so that each module defines a single circuit;

a rear wall screen at the outlet of the firebox, connected between the downcomer pipes and the riser pipes;

at least one steam generator bank downstream of the screen and also connected between the downcomer pipes and the riser pipes;

a stack connected to the firebox outlet downstream of the bank; and an economizer.

2. A boiler according to claim 1, including a selective catalytic reduction module between the firebox outlet and the stack.

3. A boiler according to claim 1, including a empty transition flue of reducing cross-sectional area between the firebox outlet and the stack.

4. A boiler according to claim 1, wherein the steam drum has an inside diameter of about 3 to about 9 feet.

5. A boiler according to claim 1, wherein the roof and floor slope at an angle of about 2 to 30 degrees to the horizontal with respect to the respect header to which the roof and floor are connected.

6. A boiler according to claim 5, wherein the roof and floor slope at an angle of about 25 to 30 degrees to the horizontal with respect to the respect header to which the roof and floor are connected.

7. A boiler according to claim 5, wherein the roof and floor slope at an angle of about 20 to 25 degrees to the horizontal with respect to the respect header to which the roof and floor are connected.

8. A boiler according to claim 5, wherein the roof and floor slope at an angle of about 15 to 20 degrees to the horizontal with respect to the respect header to which the roof and floor are connected.

9. A boiler according to claim 5, wherein the roof and floor slope at an angle of about 10 to 15 degrees to the horizontal with respect to the respect header to which the roof and floor are connected.

10. A boiler according to claim 5, wherein the roof and floor slope at an angle of about 5 to 10 degrees to the horizontal with respect to the respect header to which the roof and floor are connected.

11. A boiler according to claim 1, including additional stream generator bank downstream of the at least one stream generator bank, connected between the downcomer pipes and the riser pipes.

12. A boiler according to claim 1, including a drain for at least one lower header for draining and cleaning the circuit, the lower header have a front and a back, wherein the drain is positioned in the front of the lower header.

13. A boiler according to claim 1, wherein the at least one stream generator bank is removable.

14. A boiler according to claim 1, wherein the boiler has a generating capacity of about 75,000 to 1,000,000 lb/hr of saturated steam at pressures ranging from about 600 to 1600 psig operating pressure.

15. A boiler according to claim 1, wherein the boiler has a limited furnace heat release of less than about 120,000 Btu/hr/ft2 and a heat input per burner of about 165 MBtu/hr.

16. A boiler according to claim 1, wherein the roof and floor slope at an angle of about 2 to 5 degrees to the horizontal with respect to the respect header to which the roof and floor are connected.

17. A gravity feed, natural circulation boiler for an SAGD process using low quality feedwater for carbonatious material recovery, comprising:

a single steam drum having an inside diameter of about 3 to about 9 feet;

a plurality of downcomer pipes connected to the steam drum for discharging water from the stream drum;

a single furnace having a plurality of individually replaceable membrane wall modules, each module comprising at least one upper header, a membrane roof connected to and first sloping downwardly away from the upper header, a membrane wall connected to and descending from the membrane roof by a curved tube section, a membrane floor connected to and sloping downwardly from the membrane wall by a curved tube section, and at least one lower header connected to the membrane floor, the roof, the wall and the floor together defining a fire box having an inlet end and an outlet end, and the furnace including a membrane front wall connected to the upper and lower headers and being at the inlet end of the fire box;

means defining a windbox upstream of the front wall;

at least one burner at the inlet end of the firebox for heating the firebox;

a plurality of riser pipes connected between the steam drum and the upper header for supplying steam to the steam drum when the firebox in heated, the downcomer pipes being connected to the lower header for supplying water from the stream drum under gravity feed so that each module defines a single circuit;

a rear wall screen at the outlet of the firebox, connected between the downcomer pipes and the riser pipes;

at least one stream generator bank downstream of the screen and also connected between the downcomer pipes and the riser pipes;

a stack connected to the firebox outlet downstream of the bank;

an economizer; and a selective catalytic reduction module between the firebox outlet and the stack.

18. A boiler according to claim 17, including a empty transition flue of reducing cross-sectional area between the firebox outlet and the stack.

19. A boiler according to claim 17, wherein the roof and floor slope at an angle of about 2 to 30 degrees to the horizontal with respect to the respect header to which the roof and floor are connected.

20. A boiler according to claim 17, wherein each curved tube section has a radius of curvature of less than about 3 feet.

21. A gravity feed, natural circulation boiler for an SAGD process using low quality feedwater for carbonatious material recovery, comprising:

a single steam drum having an inside diameter of about 3 to about 9 feet;

a plurality of downcomer pipes connected to the steam drum for discharging water from the stream drum;

a single furnace having a plurality of individually replaceable membrane wall modules, each module comprising at least one upper header, a membrane roof connected to and first sloping downwardly away from the upper header, a membrane wall connected to and descending from the membrane roof, a membrane floor first sloping upward from a lower header and connected between the membrane wall and the lower header; the roof, the wall and the floor together defining a fire box having an inlet end and an outlet end, and the furnace including a membrane front wall connected to the upper and lower headers and being at the inlet end of the fire box;

means defining a windbox upstream of the front wall;

at least one burner at the inlet end of the firebox for heating the firebox;

a plurality of riser pipes connected between the steam drum and the upper header for supplying steam to the steam drum when the firebox in heated, the downcomer pipes being connected to the lower header for supplying water from the stream drum under gravity feed so that each module defines a single circuit;

a rear wall screen at the outlet of the firebox, connected between the downcomer pipes and the riser pipes;

two steam generator banks in series downstream of the screen and also connected between the downcomer pipes and the riser pipes;

a stack connected to the firebox outlet downstream of the bank;

an economizer; and a selective catalytic reduction module between the firebox outlet and the stack.

22. A boiler according to claim 21, including a drain for at least one lower header for draining and cleaning the circuit, the lower header have a front and a back, wherein the drain is positioned in the front of the lower header.

23. A boiler according to claim 21, wherein at least one of the steam generator bank is removable.

24. A boiler according to claim 21, wherein the boiler has a generating capacity of about 75,000 to 1,000,000 lb/hr of saturated steam at pressures ranging from about 600 to 1600 psig operating pressure.

25. A boiler according to claim 21, wherein the boiler has a limited furnace heat release of less than about 120,000 Btu/hr/ft2 and a heat input per burner of about 165 MBtu/hr.

26. A boiler according to claim 21, wherein the roof and floor are each connected to the wall by a curved tube section that has a radius of curvature of less than about 3 feet.

* * * * *